US007030324B2

(12) United States Patent
Gotoh

(10) Patent No.: US 7,030,324 B2
(45) Date of Patent: Apr. 18, 2006

(54) MULTI-DIRECTIONAL SWITCHING DEVICE CAPABLE OF PRODUCING GOOD FEELING OF CLICK

(75) Inventor: Kazunori Gotoh, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 377 days.

(21) Appl. No.: 10/085,643

(22) Filed: Feb. 28, 2002

(65) Prior Publication Data

US 2004/0069601 A1 Apr. 15, 2004

(51) Int. Cl.
*H01H 25/04* (2006.01)

(52) U.S. Cl. ..... 200/6 A
(58) Field of Classification Search ..... 200/4, 200/5 R, 6 A, 17 R, 18, 332, 335; 345/161
See application file for complete search history.

(56) References Cited

U.S. PATENT DOCUMENTS 6,080,941 A * 6/2000 Yokobori ..... 200/6 A
6,246,019 B1 6/2001 Nakamura et al.
6,388,210 B1 * 5/2002 Nisse ..... 200/6 A
6,541,716 B1 * 4/2003 Gotoh ..... 200/6 A
6,630,635 B1 * 10/2003 Doepner ..... 200/6 A
6,635,832 B1 * 10/2003 Oster et al. ..... 200/6 A
6,723,930 B1 * 4/2004 Minami ..... 200/6 A

* cited by examiner

*Primary Examiner*—Michael A. Friedhofer
(74) *Attorney, Agent, or Firm*—Brinks Hofer Gilson & Lione

(57) ABSTRACT

A multi-directional switching device having: a case; a switch housed in the case; one operating member capable of inclining in multi-directions, for operating the switch by means of an inclining operation in each of the directions; a first rubber dome to be operated by means of an inclining operation of the operating member; and a second rubber dome arranged in the vicinity of the first rubber dome, wherein a movable distance of the second rubber dome by the inclining operation of the operating member is made longer than that of the first rubber dome.

10 Claims, 6 Drawing Sheets

MULTI-DIRECTIONAL SWITCHING DEVICE CAPABLE OF PRODUCING GOOD FEELING OF CLICK

BACKGROUND OF THE INVENTION

1. Field of the Invention

The present invention relates to a multi-directional switching device suitable particularly for a motor-driven window mirror device for a vehicle.

2. Description of the Prior Art

The drawings of a conventional multi-directional switching device will be described. FIG. 7 is a plan view showing a conventional multi-directional switching device, FIG. 8 is a sectional view taken on line 8—8 of FIG. 7, FIG. 9 relates to a conventional multi-directional switching device, and is a sectional view taken on line 9—9 of FIG. 7 showing an elastic spring member, and FIG. 10 is a sectional view taken on line 10—10 of FIG. 7.

A box-shaped case 51 made of synthetic resin material is composed of: an upper wall 51*a*; a side wall 51*b* extendedly provided perpendicularly from the vicinity of the outer peripheral edge of the upper wall 51*a*, for enclosing the periphery; a substantially quadrangular recess 51*c* provided at the upper left side of the upper wall 51*a*; grooves 51*d* provided at four corners of the recess 51*c*; and a through hole 51*e* provided at the central part of the recess 51*c*. Also, this through hole 51*e* is formed in a cross-shaped rectangle shape, and on the outer surface portion of the through hole 51*e*, there is provided a circular arc-shaped and hemispherical receiving portion 51*f*.

Also, within the case 51, there is provided a partition plate 51*g*, which is perpendicularly extendedly provided from the upper wall 51*a* within the case 51, and this partition plate 51*g* provides a first storage 51*h* and a second storage 51*i* within the case 51 so as to be adjacent to each other. On the upper wall 51*a* located on the second storage 51*i*, there is provided a through hole 51*j*.

A substantially quadrangular elastic spring member 52 made of elastic rubber material has four rubber domes 52*a* provided at cross-shaped four corners respectively and a circular through hole 52*b* provided at the central part. This rubber dome 52*a* has a substantially cylindrical column-shaped pressing portion 52*c*, a cone 52*d* holding the pressing portion 52*c*, a substantially quadrangular base 52*e* having the cone 52*d*, and a projection 52*f* projecting downward from the outer peripheral edge of a base 52*e*. Also, the underside of the pressing portion 52*c* is disposed to overhang within the cone 52*d*.

Also, this elastic spring member 52 is disposed within the recess 51*c* of the case 51, and in this state, the projection 52*f* of the elastic spring member 52 is inserted and arranged within the groove 51*d* of the case 51, whereby the elastic spring member 52 is positioned at the case 51.

Also, in this state, within a through hole 52*b* of the elastic spring member 52, a through hole 51*e* of the case 51 is positioned.

Also, the pressing portion 52*c* of this rubber dome 52*a* and the cone 52*d* are formed such that a distance L3 between their respective under sides is comparatively short, and when a pressing force is applied to the pressing portion 52*c* of the rubber dome 52*a*, this pressing force presses the pressing portion 52*c* downward to cause the cone 52*d* to buckle, and the pressing portion 52*c* abuts against the upper wall 51*a*. Thus, since the distance L3 is comparatively short, the cone 52*d* serves as a small stroke.

An operating member 53 made of synthetic resin material is substantially circular, and has: an operating unit 53*a*; a peripheral edge 53*b* substantially perpendicularly extendedly provided from the outer peripheral edge of the operating unit 53*a*; four protrusions 53*c* protruding downward from the vicinity of the outer peripheral edge of the operating unit 53*a*, provided at respective positions of a cross shape; and a square pillar-shaped driving unit 53*d* protruding downward from the central part of the operating unit 53*a*. Also, on surfaces opposite to each other at the intermediate portion of the square pillar-shaped driving unit 53*d*, there are provided a pair of recesses 53*e*, and at the root of the driving unit 53*d*, there is provided a support 53*f* having a hemispherical recess.

The driving unit 53*d* of this operating member 53 is inserted into the through hole 51*e* of the case 51, and is held in a state in which the support 53*f* of the operating member 53 is placed on the receiving portion 51*f* of the case 51. In this state, four protrusions 53*c* provided of the operating member 53 are opposite to four pressing portions 52*c* of the rubber domes 52*a* respectively, and are brought into press contact (abut against) and disposed.

Thus, this operating member 53 is constructed such that the driving unit 53*d* thereof is inserted within the through hole 51*e* formed in a cross shape in the case 51, and that the operating member 53 is capable of inclining in four cross-shaped directions in which a first straight line X1 for passing through the center of the operating member 53 and a second straight line Y1 for passing through the center and intersecting the first straight line X1 at right angles intersect each other at right angles. Also, when the operating member 53 has been inserted into the case 51, those four rubber domes 52*a* have been respectively arranged midway between the first straight line X1 and the second straight line Y1 which are directions in which the operating member 53 inclines. In this state, the operating member 53 is inclined in each direction, whereby two protrusions 53*c* adjacent to each other which have been disposed on the inclined direction side press downward two pressing portions 52*c* of the rubber domes 52*a* which have been abutted against each other. This downward pressing causes those two cones 52*d* to buckle, and the buckling of these cones 52*d* produces the operator of the operating member 53 a feeling of click.

Also, since the smooth underside of the protrusion 53*c* of the operating member 53 made of a molded object and the smooth top surface of the pressing portion 52*c* of the rubber dome 52*a* are always brought into press contact and are in a tight contact state, the protrusion 53*c* presses the pressing portion 52*c* in the tight contact state during this inclining operation. Therefore, the cone 52*d* buckles while being pressed in a direction indicated by an arrow Z, and produces a poor feeling of click.

A holder 54 made of synthetic resin material has: a substantially hemispherical proximal portion 54*a*; a quadrangular through hole 54*b* provided at the central part of the proximal portion 54*a*; and a pair of elastic pawls 54*c* opposite to the central part of the proximal portion 54*a*.

Within the through hole 54*b* of this holder 54, the driving unit 53*d* of the operating member 53 is inserted, and the elastic pawl 54*c* is snap-in engaged in the recess 53*e* in the driving unit 53*d*, whereby the operating member 53 is prevented from coming off on the upper wall 51*a* of the case 51 and is positioned.

Also, in this state, the operating member 53 is mounted onto the upper wall 51*a* of the case 51 so as to be able to incline in four directions of the cross shape.

A sliding type switch 55 is composed of: a substantially rectangular slider 56 made of synthetic resin material; plural groups of movable contacts 57 mounted onto the underside of the slider 56; a printed circuit board 58 provided at a position opposite to the movable contact 57; and plural groups of fixed contacts (not shown) formed on the printed circuit board 58 toward and away from which the movable contact 57 moves.

Also, the slider 56 for the switch 55 has, at the central part, a square through hole 56*a*, and a recess 56*b* for housing the movable contact 57 and a coil spring 63, and within this through hole 56*a*, the driving unit 53*d* of the operating member 53 is inserted through, and the printed circuit board 58 is mounted so as to cover an open portion below the case 51. Thus, the structure is arranged such that the operating member 53 is inclined in four directions of the cross shape, whereby the slider 56 is driven horizontally with respect to the printed circuit board 58 in four directions of the cross shape, and the driving of this slider 56 causes the movable contact 57 to move toward and away on the fixed contact (not shown) for switching the contact of the switch 55.

This switch 55 is housed and arranged within a first storage 51*h* of the case 51.

A second sliding type switch 60 of FIG. 10 is composed of: a substantially rectangular slider 60*a* made of synthetic resin material; plural groups of movable contacts 60*b* mounted onto the underside of the slider 60*a*; a printed circuit board 58 provided at a position opposite to the movable contact 60*b*; and plural groups of fixed contacts (not shown) formed on the printed circuit board 58, toward and away from which the movable contact 60*b* moves.

Also, the slider 60*a* of the switch 60 has, at the central part, a projection 60*c* for projecting outwardly; and a recess 60*d* for housing the movable contact 60*b* and a coil spring 64. Also, this switch 60 is housed and arranged within the second storage 51*i*.

An operating knob 62 made of synthetic resin material is mounted by appropriate means in a state in which it has been inserted into the through hole 51*j* of the upper wall 51*a* of the case 51, and the structure is arranged such that the second sliding type switch 60 is operated by operating this operating knob 62.

A bottom wall member 59 made of synthetic resin material has a bottom wall 59*a* and a side wall 59*b* extendedly provided perpendicularly from a predetermined place on the outer peripheral edge of the bottom wall 59*a*. The bottom wall 59*a* of this bottom wall member 59 is placed on the lower part of the printed circuit board 58, and this bottom wall member 59 is mounted onto an opened end of the side wall 51*b* of the case 51 by appropriate means such as snap-in engagement.

A connector 61 has an insulating holding body 61*a*; and a terminal 61*b* held by this holding body 61*a*, and this terminal 61*b* is mounted onto the case 51 in a state in which this terminal 61*b* is electrically connected to a fixed contact (not shown) of the printed circuit board 58. The switching operation of the contact of the switch 55, 60 is outputted to an external electric device through the connector 61.

Next, the description will be made of an operation of this conventional multi-directional switch.

First, when the operating member 53 is inclined by pressing a position of point A in the left direction on the second straight line Y1 of the operating member 53 shown in FIG. 7, each pressing portion 52*c* of two rubber domes 52*a* located on both sides sandwiching the point A therebetween is pressed by each protrusion 53*c* of the operating member 53, and when this pressing portion 53*c* is pressed, the cone 52*d* buckles to produce the operator a feeling of click.

Also, since this cone 52*d* is formed into a small stroke, this feeling of click is poor.

Also, by inclining this operating member 53, the driving unit 53*d* of the operating member 53 drives the switch 55 to perform the switching operation of the switch 55 at the pressure at the point A.

At this time, since the smooth underside of the protrusion 53*c* and the smooth top surface of the pressing portion 52*c* are always brought into press contact and are in a tight contact state, the protrusion 53*c* presses the pressing portion 52*c* in the tight contact state during this inclining operation. Therefore, the cone 52*d* buckles while being pressed in a direction indicated by the arrow Z, and produces a poor feeling of click.

Next, when the pressure to the point A on the second straight line Y1 of the operating member 53 is released, restoring forces of the two rubber domes 52*a*, which have buckled restore the operating member 53 to a parallel position to the upper wall 51*a* of the original case 51.

Next, since the operations when a position of point B in the right direction on the second straight line Y1 of the operating member 53 shown in FIG. 7, and positions of points C and D in the vertical directions on the first straight line X1 are pressed are similar to the above-described pressing operation at the position of the point A in the left direction, the description will be omitted.

Next, as regards the operation of the second sliding type switch 60, by operating the operating knob 62, the slider 60*a* of the switch 60 slides on the printed circuit board 58, and the sliding of this slider 60*a* causes the switching operation of the contact of the switch 60 to be performed.

Also, this switch 60 is used to switch the left and right window mirrors of the motor-driven window mirror device, and the switch 55 is used for the switching operation of the left or right window mirror in the vertical and lateral directions.

The above-described multi-directional switching device has a problem that a sufficient feeling of click cannot be produced because small buckling of the two cones 52*d* of rubber domes produces a feeling of click.

Also, the above-described multi-directional switching device has a problem that a good feeling of click cannot be obtained for the following reason. Since the smooth underside of the protrusion 53*c* of the operating member 53 and the smooth top surface of the pressing portion 52*c* of the rubber dome 52*a* are always brought into press contact and are in a tight contact state, the protrusion 53*c* presses the pressing portion 52*c* in the tight contact state during the inclining operation of the operating member 53. Therefore, the cone 52*d* buckles while being pressed in an oblique direction (direction indicated by the arrow Z), and produces a feeling of click.

SUMMARY OF THE INVENTION

The present invention has been proposed to solve the above-described problems, and its object is to provide a multi-directional switching device capable of producing an improved tactile response to the operator (i.e., a good feeling of click).

A multi-directional switching device according to the present invention comprises: a case; a plurality of switches housed within the case; one operating member supported by the case so as to be able to incline in multi-directions, for operating any of the switches by means of an inclining operation in respective directions; a plurality of first rubber domes, any two of which are to be operated by means of inclining operations of the operating member in the respective directions; and a plurality of second rubber domes arranged in the vicinity of each of the first rubber domes any of which is to be operated concurrently with any two of the first rubber domes, and is constructed such that during the inclining operation of the operating member, the first rubber domes and the second rubber domes buckle, whereby a feeling of click is produced in the operating member, and further such that a movable distance of the second rubber dome is made longer than that of the first rubber dome.

With such a structure, buckling of the second rubber dome is added to the buckling of the first rubber dome, and therefore, a sufficient feeling of click can be obtained. Also, since a second rubber dome having a longer movable distance has been used, even when the undersides of the pressing portions of those two first rubber domes have abutted against the base of the recess of the case after the operating member is pressed and the two first rubber domes and second rubber domes buckle, the underside of the pressing portion of the second rubber dome does not abut against the base of the recess. Since the operating member is supported only by the two first rubber domes, it is possible to provide a multi-directional switching device capable of producing a stable, good feeling of click.

Also, in the multi-directional switching device according to the present invention, the first and second rubber domes have a pressing portion and a cone for holding the pressing portion respectively. A distance between an underside of the pressing portion located within the cone of the second rubber dome and that of the cone is longer than a distance between an underside of the pressing portion located within the cone of the first rubber dome and that of the cone.

Since with such a structure, the respective structures of the first and second rubber domes can be simplified, it is possible to reduce the cost and provide a low-priced multi-directional switching device.

Also, in the mutli-directional switching device according to the present invention, the operating member performs an inclining operation in four directions of a cross shape, and has, midway in the cross-shaped inclining operation directions of the operating member, four of the first rubber domes arranged in the cross shape, and four of the second rubber domes arranged one each between each of the first rubber domes adjacent to each other; and the first rubber dome and the second rubber dome are arranged at positions on the same circumference in such a manner that two of the first rubber domes and one of the second rubber domes are operated by means of an inclining operation of the operating member in one direction.

With such a structure, it is possible to provide a small-sized multi-directional switching device as a whole because the arrangement of the first and second rubber domes can occupy a minimum arrangement area while avoiding the inclining range of the supporting unit of the operating member.

Also, in the mutli-directional switching device according to the present invention, the operating member performs an inclining operation in four directions of a cross shape, and has, midway in the cross-shaped inclining operation directions of the operating member, four of the first rubber domes arranged in the cross shape, and four of the second rubber domes arranged one each between each of the first rubber domes adjacent to each other; and the four second rubber domes are arranged on a straight line on which the first rubber domes adjacent to each other are connected together in such a manner that two of the first rubber domes and one of the second rubber domes are operated by means of an inclining operation of the operating member in one direction.

With such a structure, it is possible to provide a low-priced multi-directional switching device having excellent operability, capable of making operations of the first and second rubber domes uniform.

Also, the multi-directional switching device according to the present invention is constructed such that each of the four second rubber domes is arranged at a position of the central part of each of the four first rubber domes.

Since buckling positions of the first and second rubber domes are uniformly arranged with such a structure, it is possible to obtain a further stable, good feeling of click with uniform operating forces.

A multi-directional switching device according to the present invention comprises: a case; a switch housed within the case; one operating member capable of inclining in multi-directions for operating the switch by means of an inclining operation in each of those directions; and a rubber dome to be operated by means of an inclining operation of the operating member, and is constructed such that a seat member is disposed between the operating member and the rubber dome, and during an inclining operation of the operating member, the seat member has been so designed as to perform a sliding operation between the operating member and the seat member or/and between the rubber dome and the seat member.

With such a structure, the rubber dome is vertically and smoothly buckled and this smooth buckling of the rubber dome is capable of providing a multi-directional switching device producing a good feeling of click.

Also, in the multi-directional switching device according to the present invention, for a surface of the seat member, a roughened surface for preventing tight contact is used.

With such a structure, the structure of the seat member becomes simple, and it is possible to reduce the manufacturing cost of the seat member and to provide a low-priced multi-directional switching device.

Also, in the multi-directional switching device according to the present invention, the seat member is constructed by one sheet of seat member.

With such structure, the structure of the seat member is simple, and it is possible to reduce the total number of parts of the seat member and to provide a low-priced multi-directional switching device.

Also, in the multi-directional switching device according to the present invention, the seat member is mounted onto the operating member.

With such a structure, it is simple to mount the seat member, and it is possible to reduce the assembly cost and to provide a low-priced multi-directional switching device.

Also, in the multi-directional switching device according to the present invention, the seat member mounted onto the operating member is caused to perform a sliding operation between the rubber dome and the seat member.

With such a structure, further smooth buckling of the rubber dome enables a multi-directional switching device producing a further good feeling of click to be provided.

DETAILED DESCRIPTION OF THE PREFERRED EMBODIMENTS

Figure 1:
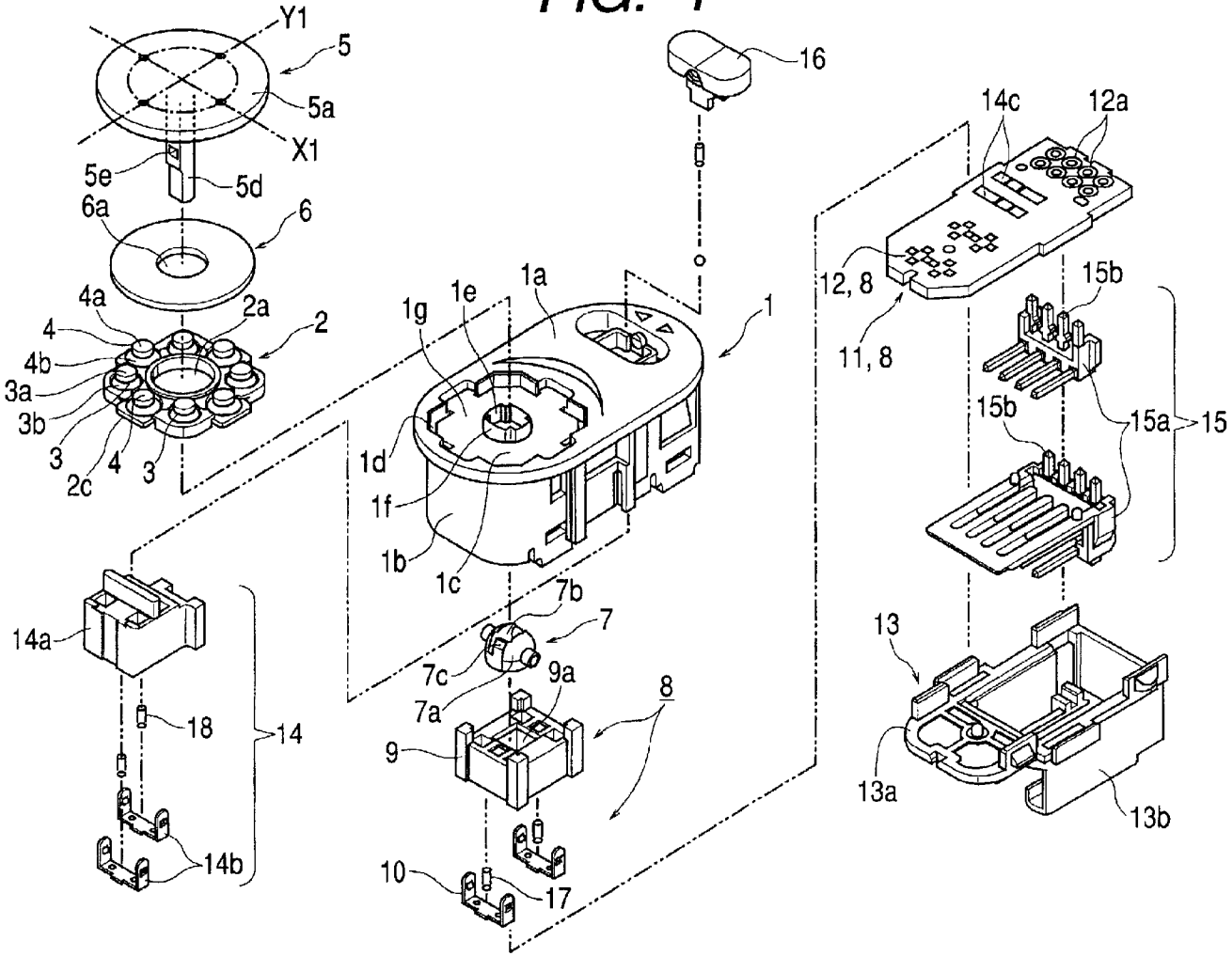
FIG. 1 is an exploded perspective view showing a multi-directional switching device according to the present invention.
Figure 2:
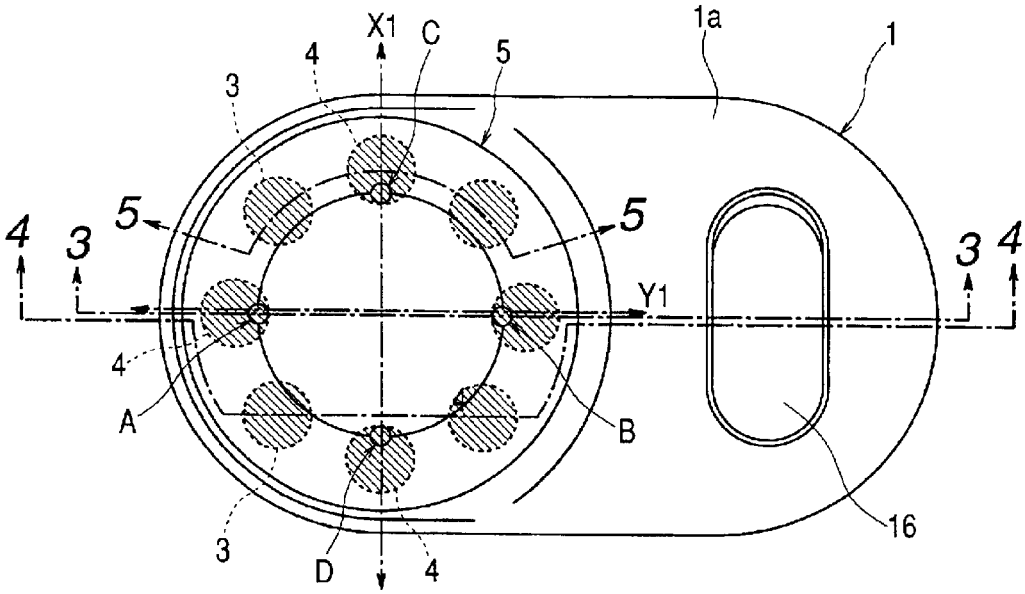
FIG. 2 is a plan view showing a multi-directional switching device according to the present invention.
Figure 3:
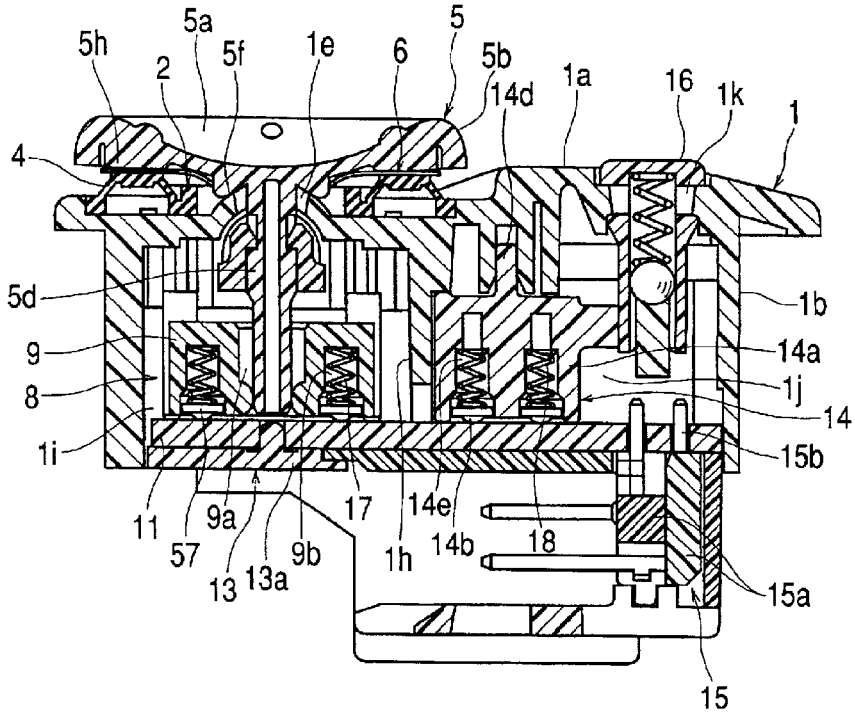
FIG. 3 is a cross-sectional view taken on line 3—3 of FIG. 2.
Figure 4:
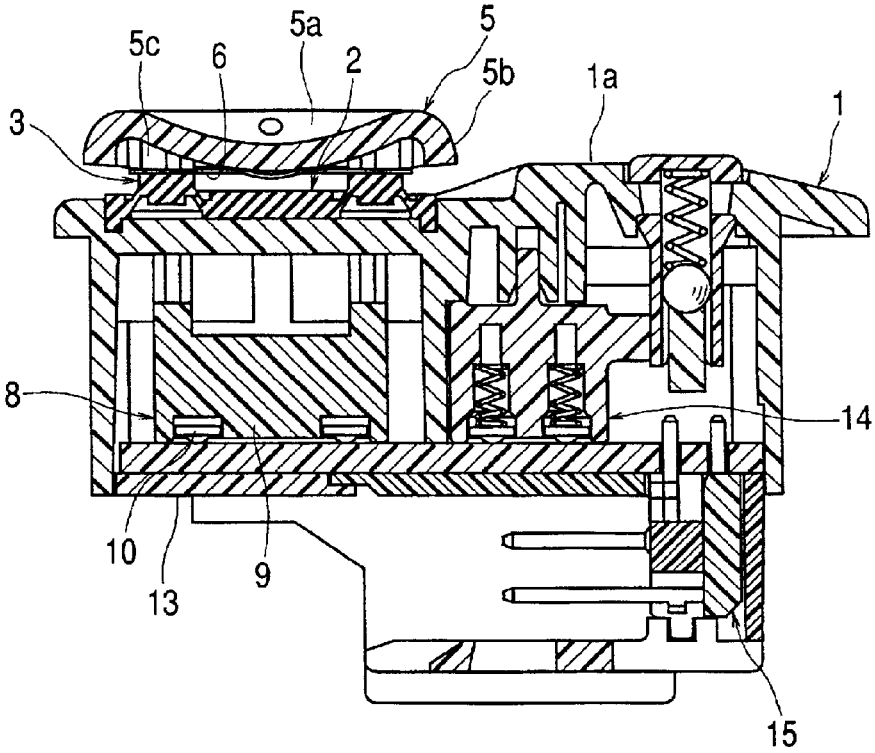
FIG. 4 is a cross-sectional view taken on line 4—4 of FIG. 2.
Figure 5:
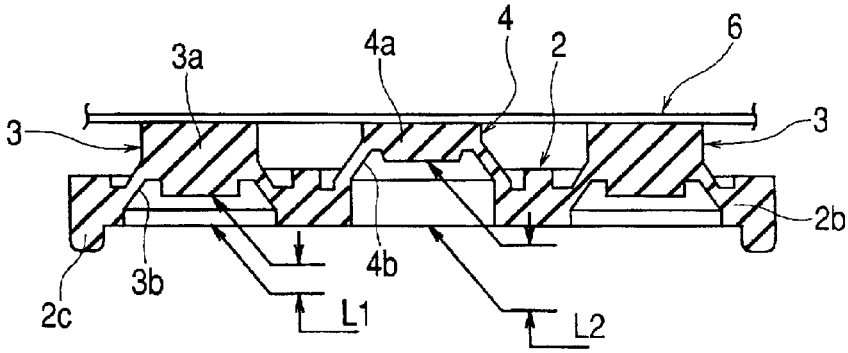
FIG. 5 relates to a multi-directional switching device according to the present invention, and is a cross-sectional view taken on line 5—5 of FIG. 2 showing an elastic spring member and a seat member.

Hereinafter, the description will be made of the drawings of a multi-directional switching device according to the present invention. FIG. 1 is an exploded perspective view showing a multi-directional switching device according to the present invention; FIG. 2 is a plan view showing a multi-directional switching device according to the present invention; FIG. 3 is a cross-sectional view taken on line 3—3 of FIG. 2; FIG. 4 is a cross-sectional view taken on line 4—4 of FIG. 2; FIG. 5 relates to a multi-directional switching device according to the present invention, and is a cross-sectional view taken on line 5—5 of FIG. 2 showing an elastic spring member and a seat member.

A box-shaped case 1 made of synthetic resin material is composed of: a substantially flat plate-shaped upper wall 1*a*; a side wall 1*b* extendedly provided perpendicularly from the vicinity of the outer peripheral edge of the upper wall 1*a*, for enclosing the periphery; a substantially quadrangular recess 1*c* provided at the upper left side of the upper wall 1*a*; grooves 1*d* provided at each of four corners of the recess 1*c*; and a through hole 1*e* provided at the central part of the recess 1*c*.

Also, this through hole 1*e* is formed in a cross-shaped rectangle shape, and on the outer surface portion of the through hole 1*e*, there is provided a circular arc-shaped and hemispherical receiving portion 1*f*.

Also, at the central part of each of four sides of the substantially quadrangular recess 1*c*, there is provided a rectangular projecting recess 1*g*.

Also, within the case 1, there is provided a partition plate 1*h*, which is perpendicularly extendedly provided within the case 1 from the upper wall 1*a*, and this partition plate 1*h* provides a first storage 1*i* and a second storage 1*j* within the case 1 so as to be adjacent to each other. On the upper wall 1*a* located on the second storage 1*j*, there is provided a through hole 1*k*.

An operating member 5 made of synthetic resin material is substantially circular, and has: an operating unit 5*a*; a peripheral edge 5*b* substantially perpendicularly extendedly provided from the outer peripheral edge of the operating unit 5*a*; first protrusions 5*c* protruding downward from the vicinity of the outer peripheral edge of the operating unit 5*a*, four of which are provided at respective positions of the cross shape; four second protrusions 5*h* provided at the central positions between each of the first protrusions 5*c*; and a square pillar-shaped driving unit 5*d* protruding downward from the central part of the operating unit 5*a*. Also, on surfaces opposite to each other at the intermediate portion of the square pillar-shaped driving unit 5*d*, there are provided a pair of recesses 5*e*, and at the root of the driving unit 5*d*, there is provided a support 5*f* having a hemispherical recess.

The driving unit 5*d* of this operating member 5 is inserted into the through hole 1*e* of the case 1, and is held in a state in which the support 5*f* of the operating member 5 is placed on the receiving portion 1*f* of the case 1.

Thus, this operating member 5 is constructed such that the operating member 5 is capable of inclining in each of four directions (cross-shaped multi-directions) which are on a first straight line X1 for passing through the center of the operating member 5 and on a second straight line Y1 for passing through the center and intersecting the first straight line X1 at right angles.

Also, each of the first protrusions 5*c* of the operating member 5 is disposed at a position sandwiched between the first and second straight lines X1 and Y1 respectively, and each of the second protrusions 5*h* is disposed at the position on the first and second straight lines X1 and Y1 respectively.

A substantially quadrangular elastic spring member 2 made of elastic rubber material has: four first rubber domes 3 provided at four corners of the cross shape respectively; four second rubber domes 4 arranged at the central position between each of first rubber domes 3 adjacent to each other; a circular through hole 2*a* provided at the central part; a first base 2*b* holding the first rubber dome 3; and a second base 2*c* holding the second rubber dome 4. Also, the first base 2*b* and the second base 2*c* are alternately located and are disposed on the same circumference contiguously to each other around the through hole 2*a*.

Also, this first rubber dome 3 has a substantially cylindrical column-shaped pressing portion 3*a*, and a cone 3*b* holding the pressing portion 3*a*, and the second rubber dome 4 has a substantially cylindrical column-shaped pressing portion 4*a*, and a cone 4*b* holding the pressing portion 4*a*. Also, the undersides of the pressing portions 3*a*, 4*a* are disposed so as to protrude within each cone 3*b*, 4*b*, and a distance between the underside of the pressing portion 3*a* of the first rubber dome 3 and that of the cone 3*b* is formed to a distance L1. A distance between the underside of the pressing portion 4*a* of the second rubber dome 4 and that of the cone 4*b* is formed to a distance L2 (L1<L2) longer than the distance L1.

More specifically, the movable distance L2 of the second rubber dome 4 due to the inclining operation of the operating member 5 is formed to have a longer distance than the movable distance L1 of the first rubber dome 3, and when a pressing force is applied to the pressing portions 3*a*, 4*a* of the first and second rubber domes 3, 4, this pressing force presses the respective pressing portions 3*a*, 4*a* downward so that the respective cones 3*b*, 4*b* are to buckle.

In this case, the distance L2 of the second rubber dome 4 is formed to be a longer distance than the distance L1 of the first rubber dome 3, whereby the second rubber dome 4 is formed to have a longer stroke and to be able to produce a better feeling of click than the first rubber dome 3.

Also, the four first rubber domes 3 and the four second rubber domes 4 are arranged at positions on the same circumference in a staggered configuration and close to each other, and the four second rubber domes 4 are arranged midway between each of the four first rubber domes 3.

Also, the first base 2*b* is formed with a projection 2*c* projecting downward from the outer peripheral edge of the first base 2*b*.

Also, this elastic spring member 2 is disposed within the recess 1*c* of the case 1, and in this state, the projection 2*c* of the elastic spring member 2 is inserted and arranged within the groove 1*d* of the case 1, whereby the elastic spring member 2 is positioned to the case 1.

Thus, in this state, each of those four second rubber domes 4 is disposed at positions opposite to each other on the first straight line X1 and on the second straight line Y1 respectively while each of those four first rubber domes 3 is disposed at respective positions midway between the first straight line X1 and the second straight line Y1, which are inclining operation directions of the operating member 5.

Thus, the first and second rubber domes 3 and 4 of this elastic spring member 2 are constructed such that by means of an inclining operation of the operating member 5 in four directions of the cross shape on the first and second straight lines X1 and Y1, the respective cones 3*b* and 4*b* buckle to produce a feeling of click caused by this buckling to the operator.

Also, as regards this buckling, two first rubber domes 3 and one second rubber dome 4 having a long stroke buckle to thereby produce a fleeing of click to the operator.

A seat member 6 made of synthetic resin material such as polyethylene terephthalate (PET) material is formed in a flat plate shape and in an annular shape, and has a circular hole 6*a* at the central part. This seat member 6 is formed to have about 0.1 mm in thickness and to have surface roughness of about 5 μm to 120 μm. This surface roughness causes the surface of the seat member 6 to be formed to be a roughened surface for preventing tight contact.

This seat member 6 is mounted onto the operating member 5 by pressing the circular hole 6*a* into the annular mounting unit 5*f* in the operating member 5.

Also, this seat member 6 is located between the first and second protrusions 5*c*, 5*h* of the operating member 5 and the pressing portions 3*a*, 4*a* of the first and second rubber domes 3, 4, and is sandwiched between the operating member 5 and the first and second rubber domes 3, 4, and is brought into press contact with each other. This press contact prevents the operating member 5 from rattling.

This state will be described in detail. The seat member 6 is sandwiched between tip end surfaces of the first and second protrusions 5*c*, 5*h* of the operating member 5 and the surfaces of the respective pressing portion 3*a*, 4*a* of the first and second rubber domes 3, 4, and is brought into press contact with each other. Since, between the surfaces of the respective pressing portions 3*a*, 4*a* of the first and second rubber domes 3, 4, and the surface of the seat member 6, the surface of the seat member 6 is a roughened surface, it becomes possible to prevent tight contact so that the structure is arranged so as to perform a sliding operation. For this reason, when the operating member 5 is pressing the respective pressing portions 3*a*, 4*a* through the seat member 6, a sliding operation is performed between the surfaces of the respective pressing portions 3*a*, 4*a* and the surface of the seat member 6, and therefore, the seat member 6 is capable of pressing the respective pressing portions 3*a*, 4*a* downward vertically so that the respective cones 3*b*, 4*b* can be smoothly buckled to thereby produce a good feeling of click.

A holder 7 made of synthetic resin material has: a substantially hemispherical proximal portion 7*a*; a quadrangular through hole 7*b* provided at the central part of the proximal portion 7*a*; and a pair of elastic pawls 7*c* opposite to the central part of the proximal portion 7*a*.

Within the through hole 7*b* of this holder 7, the driving unit 5*d* of the operating member 5 is inserted, and the elastic pawl 7*c* is snap-in engaged in the recess 5*e* in the driving unit 5*d*, whereby the operating member 5 is prevented from coming off on the upper wall 1*a* of the case 1 and is positioned.

Also, in this state, the operating member 5 is mounted onto the upper wall 1*a* of the case 1 so as to be able to incline on the first straight line X1 and on the second straight line Y1 which are four directions of the cross shape.

A sliding type switch 8 is composed of: a substantially rectangular slider 9 made of synthetic resin material; plural groups of movable contacts 10 mounted onto the underside of the slider 9; a printed circuit board 11 provided at a position opposite to the movable contact 10; and plural groups of fixed contacts 12 formed on the printed circuit board 11 toward and away from which the movable contact 10 moves.

Also, the slider 9 for the switch 8 has, at the central part, a square through hole 9*a*, and a recess 9*b* for housing the movable contact 10 and a coil spring 17, and within this through hole 9*a*, the driving unit 5*d* of the operating member 5 is inserted through, and the printed circuit board 11 is mounted so as to cover an open portion below the case 1. Thus, the structure is arranged such that the operating member 5 is inclined in four directions of the cross shape to thereby operate the driving unit 5*d*, this operation of the driving unit 5*d* drives the slider 9 horizontally with respect to the printed circuit board 11 in four directions of the cross shape, and the driving of this slider 9 moves the movable contact 10 toward and away on the fixed contact 12 for switching the contact of the switch 8.

This switch 8 is housed and arranged within a first storage 1*i* of the case 1.

A second sliding type switch 14 is composed of: a substantially rectangular slider 14*a* made of synthetic resin material; plural groups of movable contacts 14*b* mounted onto the underside of the slider 14*a*; a printed circuit board 11 provided at a position opposite to the movable contact 14*b*; and plural groups of fixed contacts 14*c* formed on the printed circuit board 11, toward and away from which the movable contact 14*b* moves.

Also, the slider 14*a* of the switch 14 has a projection 14*d* for projecting outwardly from the top surface; and a recess 14*e* for housing the movable contact 14*b* and a coil spring 18.

An operating knob 16 made of synthetic resin material is mounted by appropriate means in a state in which it has been inserted into the through hole 1*k* of the upper wall 1*a* of the case 1, and the structure is arranged such that the switch 14 is housed in the second storage 1*j* and that the second sliding type switch 14 is operated by operating this operating knob 16.

A bottom wall member 13 made of synthetic resin material has a bottom wall 13*a* and a side wall 13*b* extendedly provided perpendicularly from a predetermined place on the outer peripheral edge of the bottom wall 13*a*. The bottom wall 13*a* of this bottom wall member 13 is placed on the lower part of the printed circuit board 11, and this bottom wall member 13 is mounted onto an opened end of the side wall 1*b* of the case 1 by appropriate means such as snap-in engagement.

A connector 15 has an insulating holding body 15*a*; and a terminal 15*b* held by this holding body 15*a*, and this terminal 15*b*is electrically connected to a fixed contact 12*a* of the printed circuit board 11. The switching operation of the contacts of the switches 8, 14 is outputted to an external electric device through the connector 15.

Figure 6:
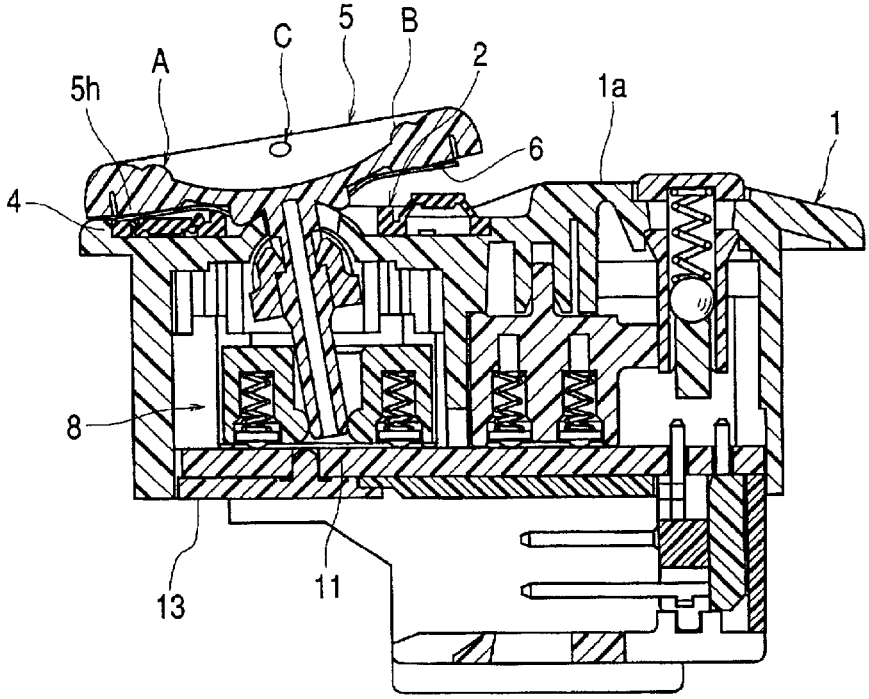
FIG. 6 relates to a multi-directional switching device according to the present invention, and is a cross-sectional view showing an inclining operation of an operating member.
Figure 7:
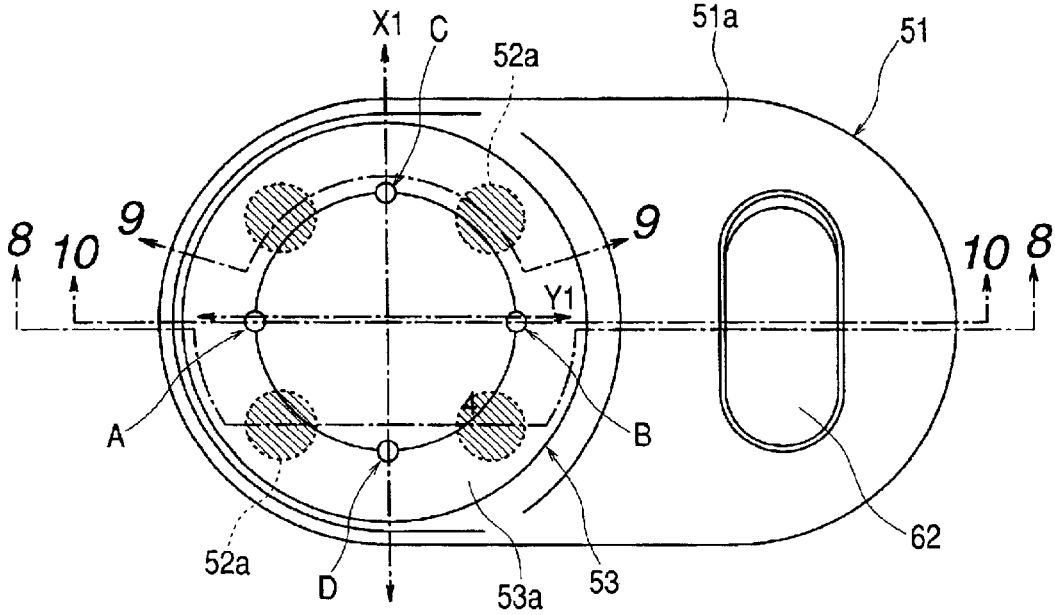
FIG. 7 PRIOR ART
FIG. 7 is a plan view showing a conventional multi-directional switching device.
Figure 8:
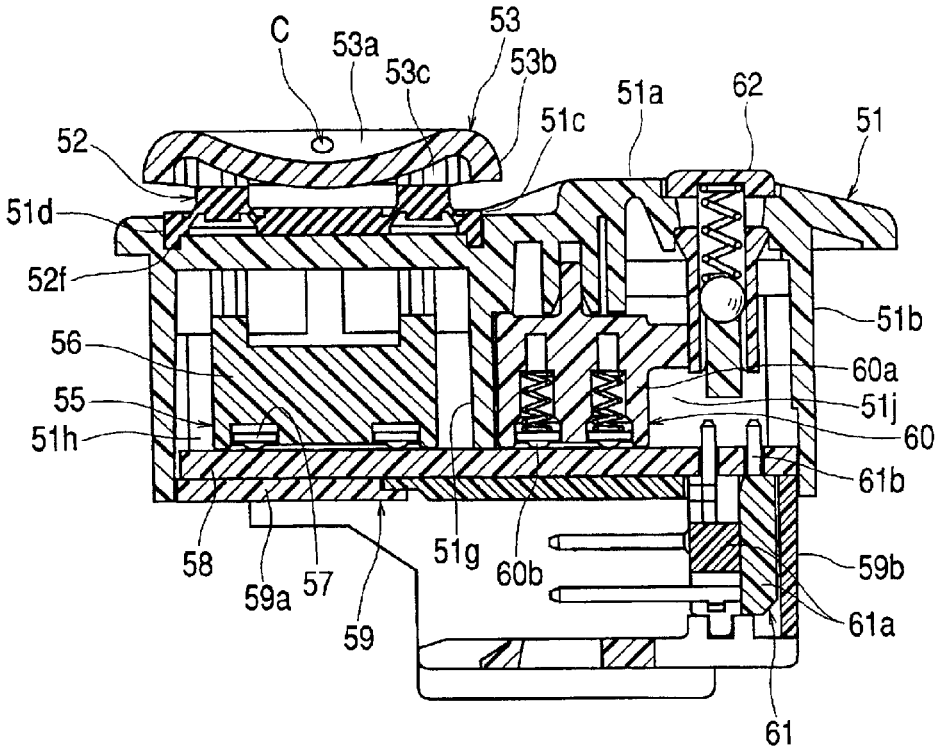
FIG. 8 PRIOR ART
FIG. 8 is a cross-sectional view taken on line 8—8 of FIG. 7.
Figure 9:
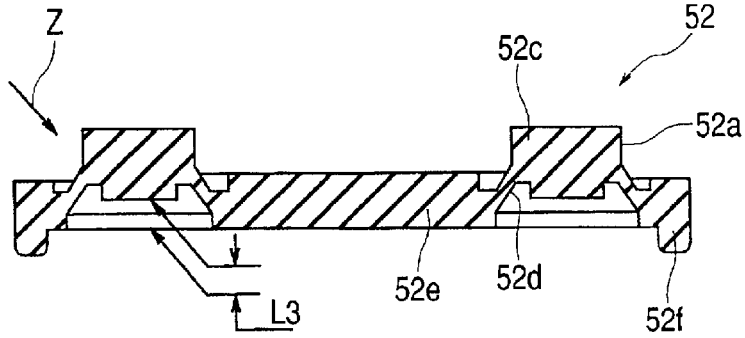
FIG. 9 PRIOR ART
FIG. 9 relates to a conventional multi-directional switching device, and is a cross-sectional view taken on line 9—9 of FIG. 7 showing the elastic spring member.
Figure 10:
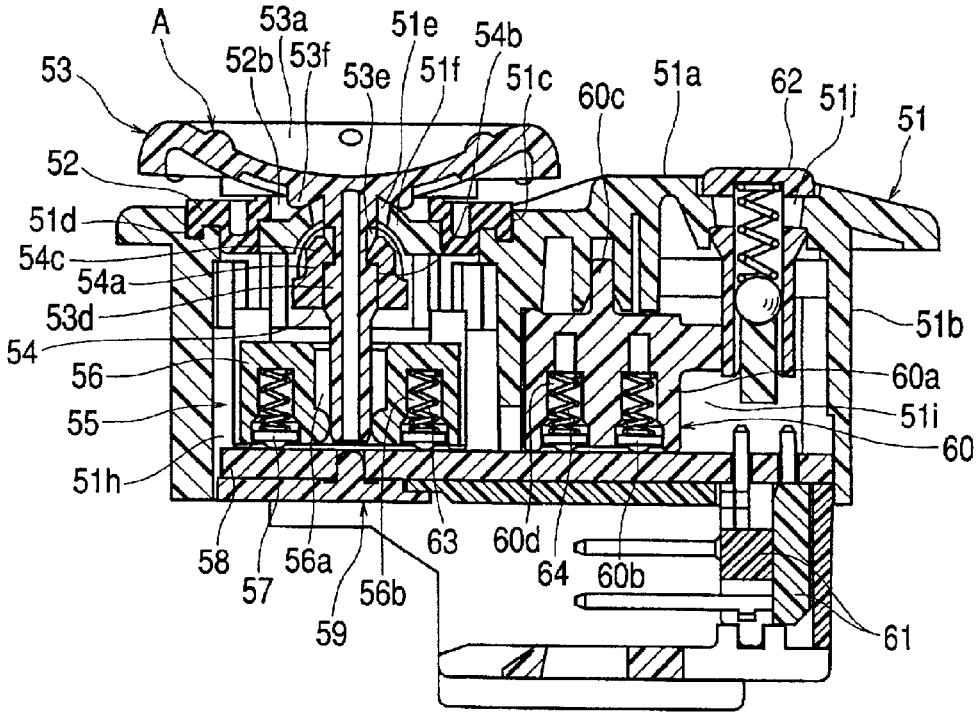
FIG. 10 PRIOR ART
FIG. 10 is a cross-sectional view taken on line 10—10 of FIG. 7.

Next, the description will be made of the drawings on an operation of a multi-directional switch according to the present invention. FIG. 6 relates to a multi-directional switching device according to the present invention, and is a cross-sectional view showing an inclining operation of an operating member.

First, when the operating member 5 is inclined in the left direction by pressing a position of point A in the left direction on the second straight line Y1 of the operating member 5 shown in FIG. 6, the second protrusion 5*h* of the operating member 5 opposite to the point A presses the pressing portion 4*a* of the second rubber dome 4 through the seat member 6, and the respective pressing portions 3*a*, 3*a* of two first rubber domes 3, 3 located on both sides sandwiching the point A therebetween is pressed by each first protrusion 5*c* of the operating member 5 through the seat member 6, and when each of these pressing portions 4*a*, 3*a*, 3*a* is pressed, each of those cones 4*b*, 3*b*, 3*b* buckles to produce the operator a strong, good feeling of click.

Also, as regards this buckling, two first rubber domes 3 and one second rubber dome 4 having a long stroke buckle to thereby produce a good fleeing of click to the operator.

Since at this operation, the surface of the seat member 6 is formed to be a roughened surface for preventing tight contact, and since a sliding operation is performed between the surface of the seat member 6 and the surface of the respective pressing portions 3*a*, 4*a*, the seat member 6 enables the respective pressing portions 3*a*, 4*a* to press downward perpendicularly, making it possible to produce a further better feeling of click to the operator.

Next, when the pressure at the point A on the operating member 5 is released, restoring forces of the three first and second rubber domes 3, 4 which have buckled restore the operating member 5 to a parallel position to the upper wall 1*a* of the original case 1.

Next, since the operations when a position of point B in the right direction on the second straight line Y1 of the operating member 5 shown in FIG. 2, and positions of points C and D in the vertical directions on the first straight line X1 are pressed and the operation when the pressure is released are similar to the above-described pressing operation and release operation at the position of the point A in the left direction, the description will be omitted.

Next, as regards the operation of the second sliding type switch 14, by operating the operating knob 16, the slider 14*a* of the switch 14 slides on the printed circuit board 11, and the sliding of this slider 14*a* causes the switching operation of the contact of the switch 14 to be performed.

Also, this switch 14 is used to switch the left and right window mirrors of the motor-driven window mirror device, and the switch 8 is used for the angle switching operation of the left or right window mirror in the vertical and lateral directions.

In this respect, in the embodiment according to the present invention, the structure is arranged so as to be able to incline in four directions of the cross shape, but the present invention is not limited to those four directions, as long as the operating member is inclinable in multi-directions.

Also, in the embodiment according to the present invention, four sliding type switches and four first and second rubber domes are used, but the present invention is not limited to four respectively.

Also, in the embodiment according to the present invention, four first rubber domes and four second rubber domes are arranged at positions on the same circumference, but the present invention is not limited thereto, and four second rubber domes may be arranged on straight lines for connecting the first rubber domes which are adjacent to each other.

Also, in the embodiment according to the present invention, four second rubber domes are arranged at positions midway between each of four first rubber domes, but the present invention is not limited thereto, and the second rubber domes may be deviated from the intermediate part and be arranged in positions close to the first rubber dome.

Also, in the embodiment according to the present invention, the seat member is disposed on the operating member, but the present invention is not limited thereto, and the seat member may be disposed on the rubber domes.

Also, in the embodiment according to the present invention, between the rubber dome and the seat member, a sliding operation is caused to be performed, but the present invention is not limited thereto, and between the operating member and the seat member, the sliding operation maybe caused to be performed, and further, both between the seat member and the operating member, and between the seat member and the rubber dome, the sliding operation may be caused to be performed.

Also, in the embodiment according to the present invention, the seat member is constructed by one sheet of seat member, but a seat member divided into a plurality of sheets may be used.

As described above, according to the present invention, it is possible to provide a multi-directional switching device capable of producing a good feeling of click caused by substantially simultaneous buckling of the first and second rubber domes because the structure is arranged such that a movable distance of the second rubber dome due to the inclining operation of the operating member longer than that of the first rubber dome, and because during the inclining operation of the operating member, the first and second rubber domes have been so designed as to buckle, whereby a feeling of click by buckling of the second rubber dome is better than a feeling of click by buckling of the first rubber dome.

Also, according to the present invention, it is possible to provide a low-priced multi-directional switching device capable of reducing the cost because the first and second rubber domes have a pressing portion and a cone for holding the pressing portion respectively, and a distance between the underside of the pressing portion located within the cone of the second rubber dome and the underside of the cone is longer than a distance between the underside of the pressing portion located within the cone of the first rubber dome and the underside of the cone, whereby the structures of the first and second rubber domes can be simplified.

Also, a multi-directional switching device according to the present invention is capable of obtaining a further stable, good feeling of click because each of those four second rubber domes is arranged at positions midway between each of those four first rubber domes, whereby buckling positions of the first and second rubber domes have been uniformly arranged.

Also, a multi-directional switching device according to the present invention is constructed such that a seat member is disposed between the operating member and the rubber dome, and during an inclining operation of the operating member, the seat member is so designed as to perform a sliding operation between the operating member and the seat member or/and between the rubber dome and the seat member. With such a structure, the rubber dome is vertically and smoothly buckled and this smooth buckling of the rubber dome is capable of providing a multi-directional switching device producing a good feeling of click.

Also, in the multi-directional switching device according to the present invention, the seat member consists of a single sheet of material, whereby the structure of the seat member is simple, and it is possible to reduce the total number of parts of the seat member and to provide a low-priced multi-directional switching device.

What is claimed is:

1. A multi-directional switching device comprising: a case; a plurality of switches housed within the case; one operating member supported by the case so as to be able to incline in multi-directions, the operating member to operate any of the switches by an inclining operation in respective directions; a plurality of first rubber domes, any two of which are to be operated by inclining operations of the operating member in the respective directions; and a plurality of second rubber domes arranged in a vicinity of each of the first rubber domes any of which is to be operated concurrently with any two of the first rubber domes, wherein the switching member is arranged such that during the inclining operation of the operating member, the first rubber domes and the second rubber domes buckle, whereby a feeling of click is produced in the operating member, and wherein a movable distance of the second rubber domes is longer than that of the first rubber domes.

2. The multi-directional switching device according to claim 1, wherein each of the first and second rubber domes have a pressing portion and a cone to hold the pressing portion respectively, and wherein a distance between an underside of the pressing portion located within the cone of each of the second rubber domes and an underside of the cone of each of the second rubber domes is longer than a distance between an underside of the pressing portion located within the cone of each of the first rubber domes and an underside of the cone of each of the first rubber domes.

3. The multi-directional switching device according to claim 2, wherein the operating member is inclinable in four directions of a cross shape, and has, midway in the cross-shaped inclining operation directions of the operating member, four of the first rubber domes arranged in the cross shape, and four of the second rubber domes arranged one each between each of the first rubber domes adjacent to each other, and wherein the first rubber domes and the second rubber domes are arranged at positions on the same circumference such that two of the first rubber domes and one of the second rubber domes are operated by an inclining operation of the operating member in one direction.

4. The multi-directional switching device according to claim 2, wherein the operating member is inclinable in four directions of a cross shape, and has, midway in the cross-shaped inclining operation directions of the operating member, four of the first rubber domes arranged in the cross shape, and four of the second rubber domes arranged one each between each of the first rubber domes adjacent to each other, and wherein the four second rubber domes are arranged on a straight line on which the first rubber domes adjacent to each other are connected together such that two of the first rubber domes and one of the second rubber domes are operated by an inclining operation of the operating member in one direction.

5. The multi-directional switching device according to claim 3, wherein each of the four second rubber domes is arranged at a position of a central part between each of the four first rubber domes.

6. A multi-directional switching device comprising: a case; a switch housed within the case; one operating member inclinable in multi-directions to operate the switch by an inclining operation in each of the directions; and a rubber dome to be operated by the inclining operation of the operating member, wherein a seat member is disposed between the operating member and the rubber dome, and wherein during the inclining operation of the operating member, the seat member performs a sliding operation between: one of the operating member and the seat member and between the rubber dome and the seat member.

7. The multi-directional switching device according to claim 6, wherein a surface of the seat member is roughened for preventing tight contact.

8. The multi-directional switching device according to claim 7, wherein the seat member comprises a single sheet of material.

9. The multi-directional switching device according to claim 8, wherein the seat member is mounted onto the operating member.

10. The multi-directional switching device according to claim 9, wherein the seat member mounted onto the operating member performs a sliding operation between the rubber dome and the seat member.

* * * * *